US005823107A

United States Patent [19]

Beisel et al.

[11] Patent Number: 5,823,107

[45] Date of Patent: Oct. 20, 1998

[54] OFFSET PRINTING PRESS

[75] Inventors: Hermann Beisel, Walldorf; Rudi Junghans, Wilhelmsfeld, both of Germany

[73] Assignee: Heidelberger Druckmaschinen Aktiengesellschaft, Heidelberg, Germany

[21] Appl. No.: 744,868

[22] Filed: Nov. 7, 1996

[30] Foreign Application Priority Data

Nov. 7, 1995 [DE] Germany ..... 195 41 418.7

[51] Int. Cl.[6] ..... B41F 23/04; B41F 23/16

[52] U.S. Cl. ..... 101/148; 101/350.1

[58] Field of Search ..... 101/147, 148, 101/142, 143, 144, 348, 349.1, 350.01, 352.01, 352.09

[56] References Cited

U.S. PATENT DOCUMENTS

| | | | |
|---|---|---|---|
| 4,351,236 | 9/1982 | Beisel et al. . | |
| 4,440,081 | 4/1984 | Beisel . | |
| 4,905,593 | 3/1990 | Gollinger et al. | 101/148 |
| 4,944,223 | 7/1990 | Ishii et al. | 101/148 |
| 4,986,176 | 1/1991 | Ishii et al. | 101/148 |
| 5,025,724 | 6/1991 | Holl et al. . | |
| 5,218,903 | 6/1993 | MacConnell et al. | 101/148 |
| 5,623,873 | 4/1997 | Ikeda | 101/147 |

FOREIGN PATENT DOCUMENTS

| | | |
|---|---|---|
| 0353194 | 1/1990 | European Pat. Off. . |
| 0478493 | 4/1992 | European Pat. Off. . |
| 2845932 | 4/1980 | Germany . |
| 3146223 | 6/1983 | Germany . |
| 3641013 | 10/1987 | Germany . |
| 3825517 | 2/1990 | Germany . |
| 3908043 | 4/1990 | Germany . |
| 4013741 | 10/1991 | Germany . |
| 9316916 | 3/1994 | Germany . |
| 4419850 | 12/1995 | Germany . |

*Primary Examiner*—Ren Yan
*Attorney, Agent, or Firm*—Nils H. Ljungman and Associates

[57] ABSTRACT

An offset printing press with an inking unit and a wetting unit which correspond to a plate cylinder, with at least one intermediate roller which connects the inking and wetting units. The intermediate roller is bilaterally mounted on bearings and can be adjusted by an actuator device with respect to an inking and/or a wetting roller. The stenciling on the inking roller is reduced during separate operation between the inking unit and the wetting unit by having the intermediate roller remain in contact with the inking roller when the intermediate roller is disengaged from the wetting roller.

20 Claims, 6 Drawing Sheets

OFFSET PRINTING PRESS

BACKGROUND OF THE INVENTION

1. Field of the invention

The present invention generally relates to an offset printing press with an inking and a wetting mechanism which correspond to a plate cylinder, with at least one intermediate roller which connects the friction-driven inking and wetting rollers. The intermediate roller is mounted bilaterally on systems of bearings and can be adjusted by means of actuation means in relation to an inking and/or a wetting roller.

2. Background Information

German Patent No. 40 13 741 A1 describes a known device, in which the intermediate roller can be adjusted by means of two actuating means with respect to an inking roller or a wetting roller. The purpose of this known device is to achieve economical operation and to reduce setup times.

OBJECT OF THE INVENTION

The object of the present invention, when the inking unit and the wetting unit are operated separately, is to reduce the stenciling on the first inking roller, so that even difficult printing jobs can be performed.

SUMMARY OF THE INVENTION

The present invention teaches that this object can be accomplished if the intermediate roller is mounted on both sides on pivoted levers, so that when adjusted or during an adjustment, the intermediate roller remains in contact with the first inking roller, and when stopped the intermediate roller is raised from the wetting roller. In this solution, if the intermediate roller is raised from the wetting roller, so that the wetting unit is separated from the inking unit, the intermediate roller remains in rolling contact with the first inking roller, and here the intermediate roller can smooth out the ink film on the inking roller as the ink film returns from the plate, and thus prevent stenciling. In this position, the wetting unit can wet the printing plate independently of the inking unit. In this case, for example, the wetting roller can be driven at a speed which is different from the speed of the plate cylinder.

One advantageous embodiment of the present invention is characterized by the fact that pivoted levers can be located bilaterally, i.e., on both sides, on the systems of bearings of the first inking roller. The intermediate roller can be mounted in these pivoted levers, and there can be actuator means which can correspond to the pivoted levers. In this embodiment, therefore, the intermediate roller preferably pivots around the first inking roller, so that when the intermediate roller is removed from the wetting roller, the intermediate roller can essentially always remain in contact with the inking roller.

An additional advantageous embodiment of the invention is characterized by the fact that pivoted levers can be located bilaterally on the systems of bearings of the wetting roller, and corresponding to these pivoted levers there can be actuators. The pivoting bearing levers can be fastened to articulated levers, and the intermediate roller can be mounted on these bearing levers. Preferably engaged with the bearings of the intermediate roller are connecting rods which can be pivotably mounted on both sides on the bearings of the first inking roller. In this variant mounting of the intermediate roller, the connecting rods can essentially provide continuous contact between the intermediate roller and the first inking roller, so that when the intermediate roller is stopped, contact with the first inking roller can be maintained.

The present invention teaches that it can also be advantageous if on the connecting rods there are preferably actuator means which can be engaged with the bearings of the intermediate roller, to preferably set the distance between the intermediate roller and the first inking roller.

An additional variant of the system of bearings of the intermediate roller is characterized by the fact that on both sides, on the system of bearings of the wetting roller, pivoted levers can be mounted, corresponding to which there can be actuator means. Pivoting bearing levers can be fastened to the pivoted levers. The intermediate roller can be mounted on the pivoting bearing levers, and corresponding to the bearing levers there can be compression springs which preferably apply the intermediate roller against the first inking roller. The compression springs can be held by support bodies which can be fastened to the pivoted levers. The compression springs can essentially provide a clearance-free application of the intermediate roller against the first inking roller, whereby preferably the pressure of the compression springs can determine the application force. For the removal of the intermediate roller, during which the intermediate roller is raised from the first wetting roller, the application against the first inking roller can essentially be unaffected.

An additional variant embodiment of the present invention is characterized by the fact that on both sides of the system of bearings of the wetting roller, pivoted levers can preferably be mounted, corresponding to which there can be actuator means. On the articulated levers there can preferably be guides in which the bearings of the intermediate roller can preferably slide. The guides can preferably be oriented at an angle alpha in relation to the first inking roller, so that the application pressure of the intermediate roller against the first inking roller can preferably be greater than the application pressure of the intermediate roller against the wetting roller. In this variant embodiment, even in the applied position, the intermediate roller can preferably be driven by the higher application pressure of the first inking roller, essentially regardless of the speed at which the wetting roller is driven.

A further additional variant embodiment of the present invention is a device for selectively engaging a wetting unit with an inking unit of a plate cylinder in an offset printing press, the device including a wetting unit, the wetting unit including a wetting roller, an inking unit, the inking unit including an inking roller, an intermediate roller, the intermediate roller having a first end and a second end, the first end of the intermediate roller is axially opposite the second end of the intermediate roller, a pivoting arrangement for pivoting the intermediate roller about the inking roller and maintaining the intermediate roller in contact with the inking roller, the pivoting arrangement including a first lever, the first end of the intermediate roller being rotatingly mounted on the first lever, a second lever, the second end of the intermediate roller being rotatingly mounted on the second lever, each of the first lever and the second lever being disposed to pivot about its corresponding pivot point, and actuation apparatus for pivoting each of the first lever and the second lever about its corresponding pivot point to engage and disengage the intermediate roller with the wetting roller.

Yet another further additional variant embodiment of the present invention is an offset printing press, the offset printing press including a plate cylinder, an inking unit for the plate cylinder, the inking unit including an inking roller, a wetting unit for the plate cylinder, the wetting unit including a wetting roller, an intermediate roller for connecting the inking roller and the wetting roller, the intermediate roller having a first end and a second end, the first end of the intermediate roller being opposite the second end of the intermediate roller, apparatus for selectively connecting the inking roller and the wetting roller with the intermediate roller and for keeping the intermediate roller in contact with the inking roller, the apparatus for selectively connecting the inking roller and the wetting roller with the intermediate roller and for keeping the intermediate roller in contact with the inking roller including: a first lever, the first end of the intermediate roller being rotationally mounted on the first lever, a second lever, the second end of the intermediate roller being rotationally mounted on the second lever; and apparatus for actuating the apparatus for selectively connecting the inking roller and the wetting roller with the intermediate roller and for keeping the intermediate roller in contact with the inking roller.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Embodiments of the invention are illustrated schematically and by way of example in the accompanying drawings, of which.

DESCRIPTION OF THE PREFERRED EMBODIMENT

Figure 1:
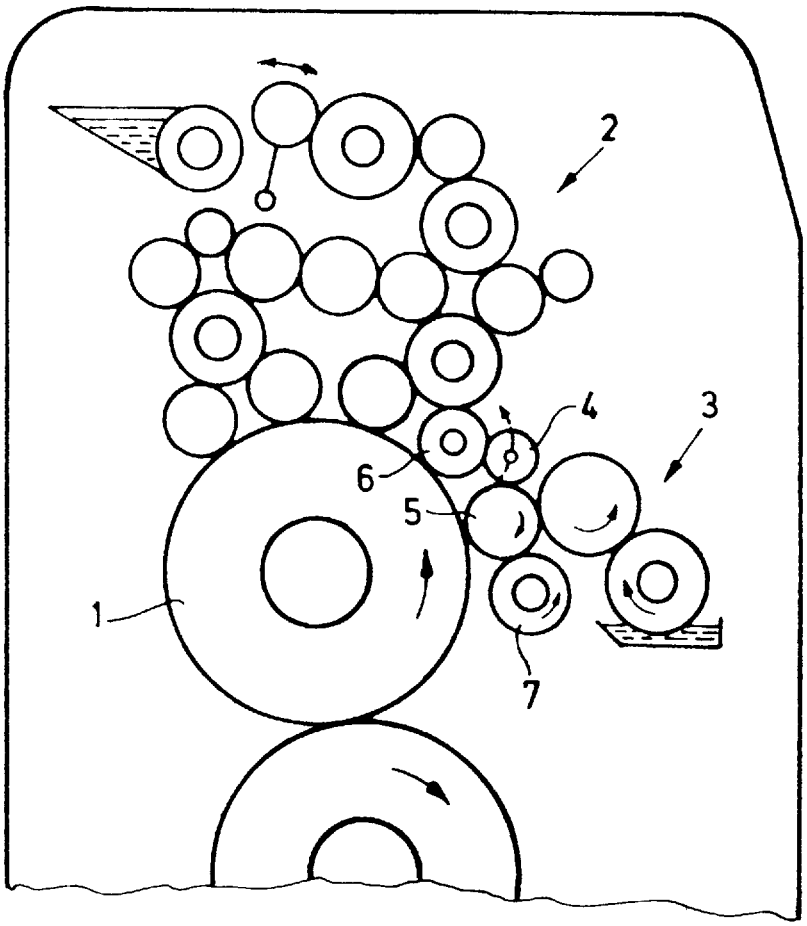
FIG. 1 shows a side view of an inking-wetting unit.

In FIG. 1, corresponding to a plate cylinder 1 there can be an inking unit 2 and a wetting unit 3. An intermediate roller 4 can connect a wetting roller 5 with a first inking roller 6. In the illustrated embodiment, the wetting roller 5 has a distributing roller 7 which is provided with a drive mechanism (not shown). The distributing roller 7 can drive the wetting roller 5 and essentially prevent a stenciling of the wetting roller 5. The intermediate roller 4 can be mounted bilaterally on pivoted levers (described below, see for example lever 8 shown in FIG. 2), which pivoting levers in turn can be located on the systems of bearings of the first inking roller 6, so that the intermediate roller 4, when it is turned off, can pivot around the first inking roller 6, and remain in rolling contact with the first inking roller 6. The intermediate roller 4 can thereby be raised from the wetting roller 5.

In other words, as shown in FIG. 1, the wetting roller 5 can be rotatably driven by engagement of the wetting roller 5 with the distributing roller 7. The distributing roller 7 can also indirectly drive the first inking roller 6 via the intermediate roller 4. The intermediate roller 4 can engage both the wetting roller 5 and the first inking roller 6, as shown in FIG. 1, to transfer torque from the wetting roller 5 to the first inking roller 6 and thereby drive the first inking roller 6.

However, it can be desirable to turn off the drive connection between the wetting roller 5 and the first inking roller 6 to independently drive the wetting roller 5 and/or the first inking roller 6 with respect to one another and/or the plate cylinder 1. Yet it can also be desirable that the intermediate roller 4 remain engaged and be in rolling contact with the first inking roller 6 even when the drive connection is stopped (i.e., when the intermediate roller 4 is disengaged from the wetting roller 5), to continue to smooth out the ink film on the first inking roller 6 and thereby essentially eliminate stenciling.

As discussed with respect to the embodiments illustrated in FIGS. 2–5 below, the intermediate roller 4 can pivot around the first inking roller 6 to engage and disengage the intermediate roller 4 from the wetting roller 5 while the intermediate roller 4 remains in rolling contact with the first inking roller 6 throughout.

Figure 2:
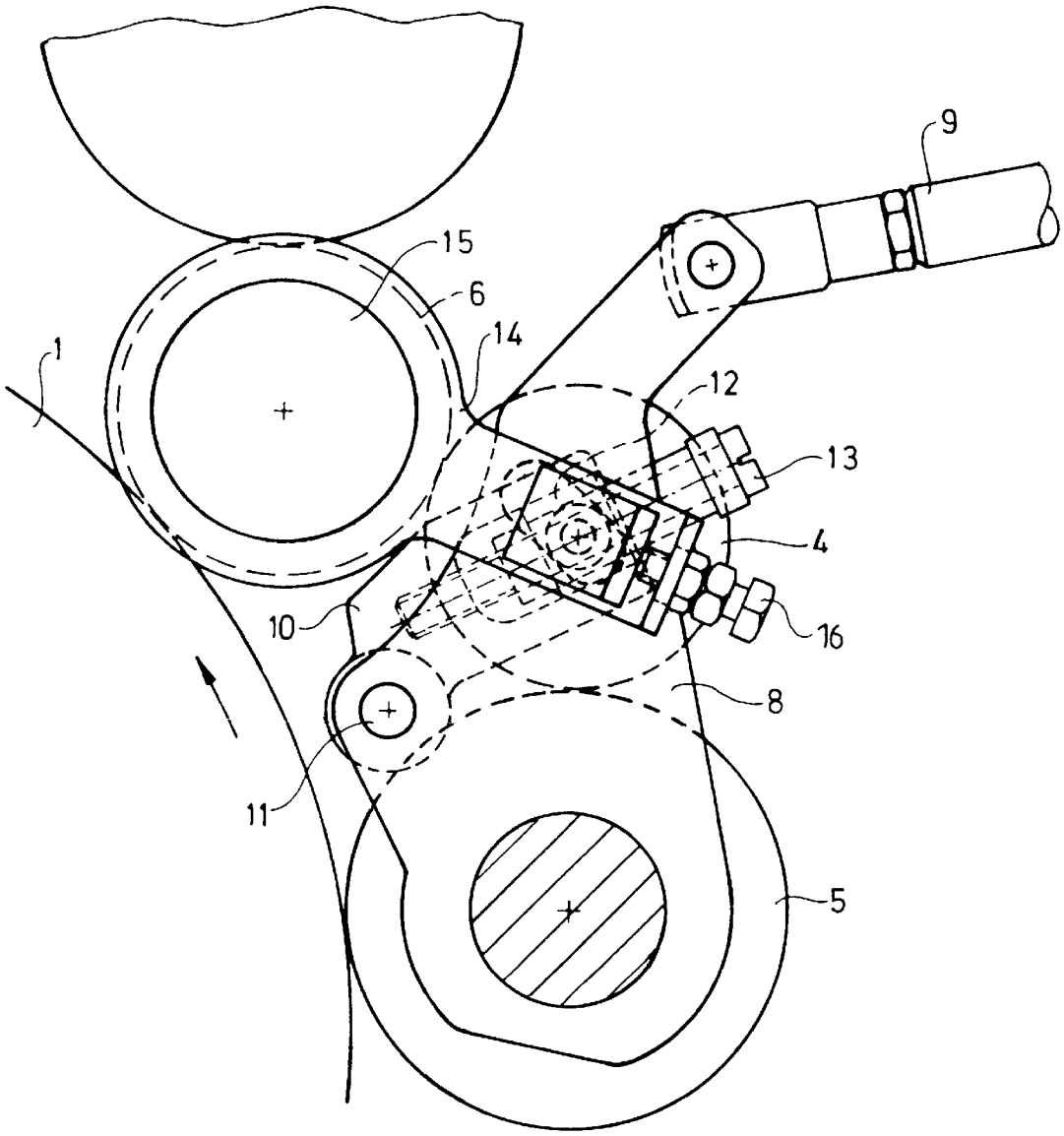
FIG. 2 shows a system of bearings of the intermediate roller.
Figure 3:
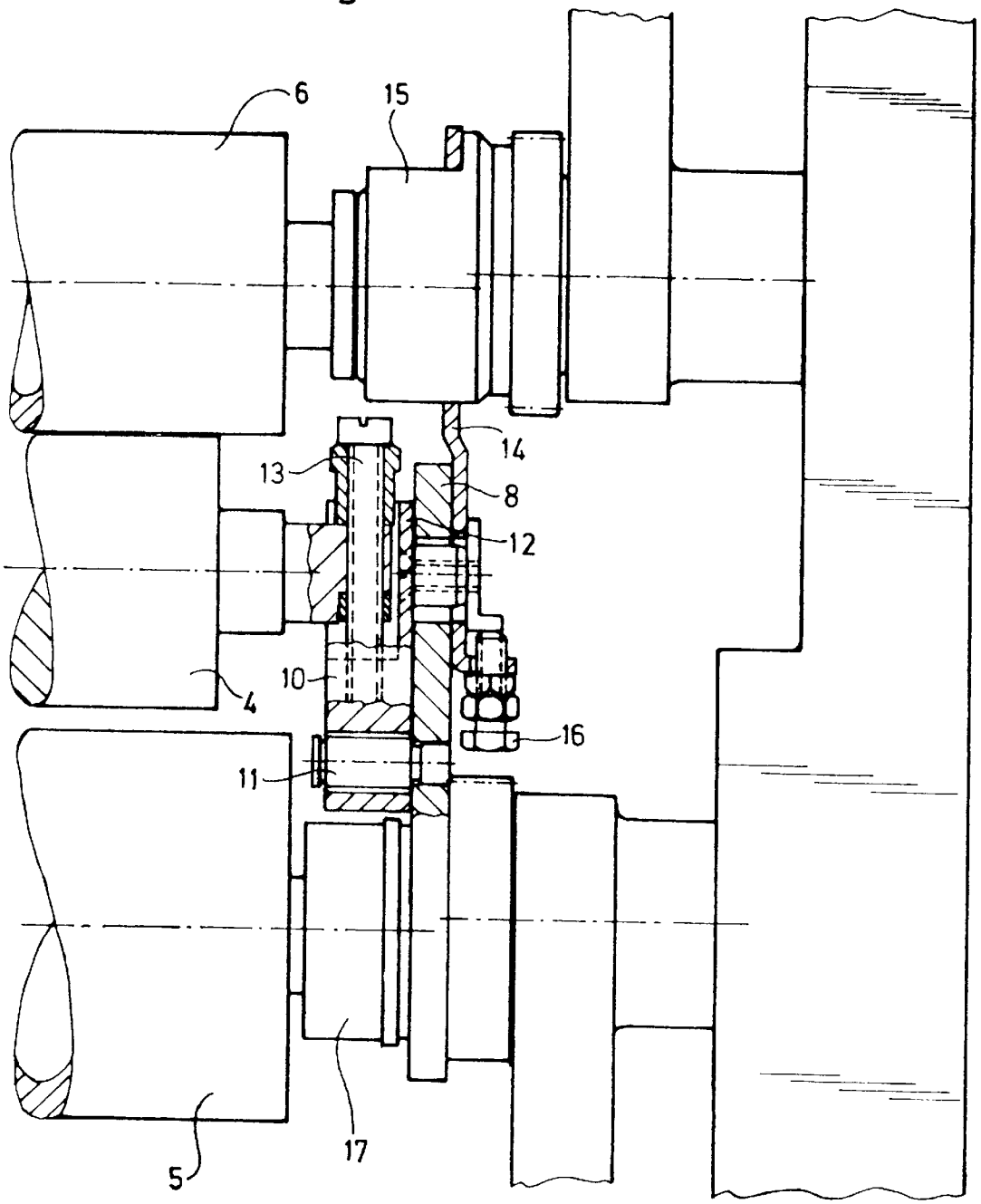
FIG. 3 shows a partial longitudinal section through the system of bearings of the intermediate roller.

In the embodiment illustrated in FIGS. 2 and 3, the intermediate roller 4 is mounted bilaterally by means of pivoted levers 8 (one of which is shown in FIGS. 2 and 3) on the arrangement of bearings of the wetting roller 5. Corresponding once again to the pivoted levers 8 are actuator means 9. By means of the actuator means 9 the intermediate roller 4 can be removed from, or disengaged from, the wetting roller 5. Bearing levers 10 on journals 11 can be pivotably fastened to the pivoted levers 8, and the intermediate roller 4 can be mounted on the journals 11 by means of bearings 12. The bearings 12 can be adjusted by means of set screws 13 in the bearing levers 10. Engaged with the bearings 12 of the intermediate roller 4 can be connecting rods 14, which can be mounted so that the connecting rods 14 can pivot bilaterally on systems of bearings 15 of the first inking roller 6. The distance between the first inking roller 6 and the intermediate roller 4 can be adjusted by actuator means, as for example, set screws 16. The connecting rods 14 therefore can cause the intermediate roller 4 to be in contact with essentially constant pressure against the first inking roller 6, essentially regardless of whether the intermediate roller 4 is removed by means of the actuator means 9 from the wetting roller 5. In this case, it must be taken into consideration that the bearing systems 15 of the first inking roller 6 and the bearing systems 17 of the wetting roller 5 can be realized so that both rollers, the first inking roller 6 and the wetting roller 5, can be removed from the cylindrical surface of the plate cylinder 1.

In other words, FIGS. 2 and 3 illustrate a device for selectively engaging the wetting unit 3 with the inking unit 2 of the plate cylinder 1. A pivoting arrangement for pivoting the intermediate roller 4 about the first inking roller 6 and maintaining the intermediate roller 4 in contact with the first inking roller 6 is shown. The pivoting arrangement preferably includes the pivoted levers 8, which, in this embodiment, are mounted to pivot about the axis of rotation of the wetting roller 5. The intermediate roller 4 can be mounted to the pivoted levers 8 by means of a second pivoting arrangement that can include the bearing levers 10 pivotally mounted to the pivoted levers 8. The second pivoting arrangement, for the embodiment shown, can also include two additional levers, i.e. the connecting rods 14.

Figure 3A:
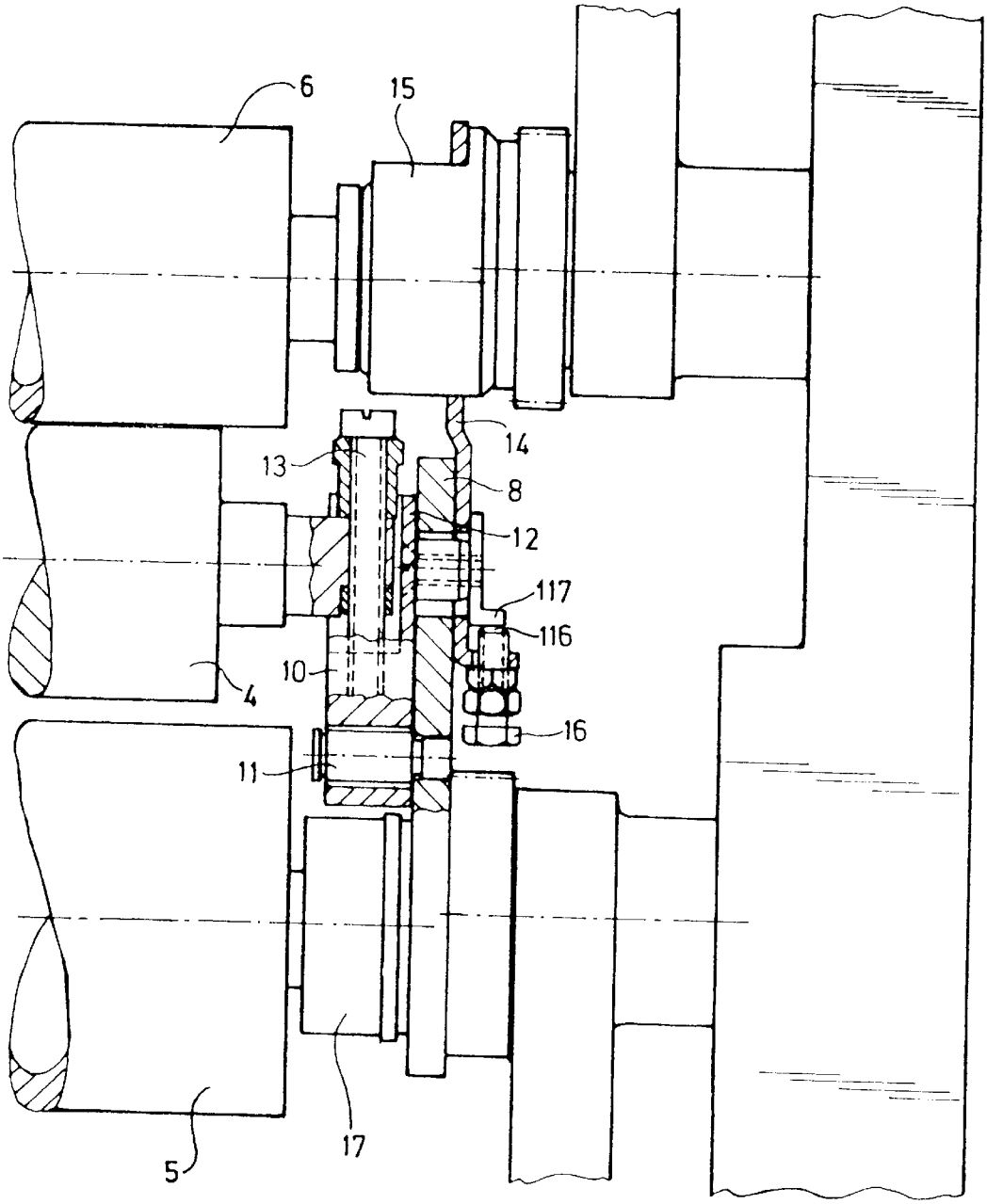
FIG. 3*a* is similar to FIG. 3 but shows additional reference numerals.

To adjust the distance between the first inking roller 6 and the intermediate roller 4 (as for example, to accommodate dimensional tolerances or to install a different sized roller), an adjusting apparatus can be used. As shown in FIGS. 2 and 3, an embodiment of the present invention can include the set screw 16. An end 116 (see FIG. 3*a*) of the set screw 16 can act as a stop, and can engage a stop 117 (see FIG. 3*a*) attached to the corresponding bearing lever 10. By turning the set screw 16, the bearing levers 10 can be caused to pivot while the pivoted levers 8 remain stationary, to effectuate a distance adjustment.

It should also be recognized that the pivoting arrangement for pivoting the intermediate roller 4 about the first inking roller 6 and maintaining the intermediate roller 4 in contact with the first inking roller 6 can have the pivoted levers mounted to rotate about the axis of rotation of the first inking roller 6. For example, in the embodiment shown in FIGS. 2 and 3, the pivoted levers mounted to pivot about the axis of rotation of the first inking roller 6 can be the connecting rods 14. Similarly, a second pivoting arrangement can be used to mount the intermediate roller 4 to the connecting rods 14; the second pivoting arrangement can include the bearing levers 10 and the pivoted levers 8. In such an embodiment, the set screw 16 can be seen as an actuation device to engage and disengage the intermediate roller 4 with the wetting roller 5. Rather than the set screw 16, other actuation devices (as for example, a pneumatic or hydraulic cylinder) could be preferably alternately employed to engage with the stop 117 to selectively engage and disengage the intermediate roller 4 with the wetting roller 5. By using set screw 16 or an alternative thereof as an actuation device, the actuation device 9 in alternative embodiments of the present invention could be eliminated or could be used as an alternative or backup means of actuation.

Figure 4:
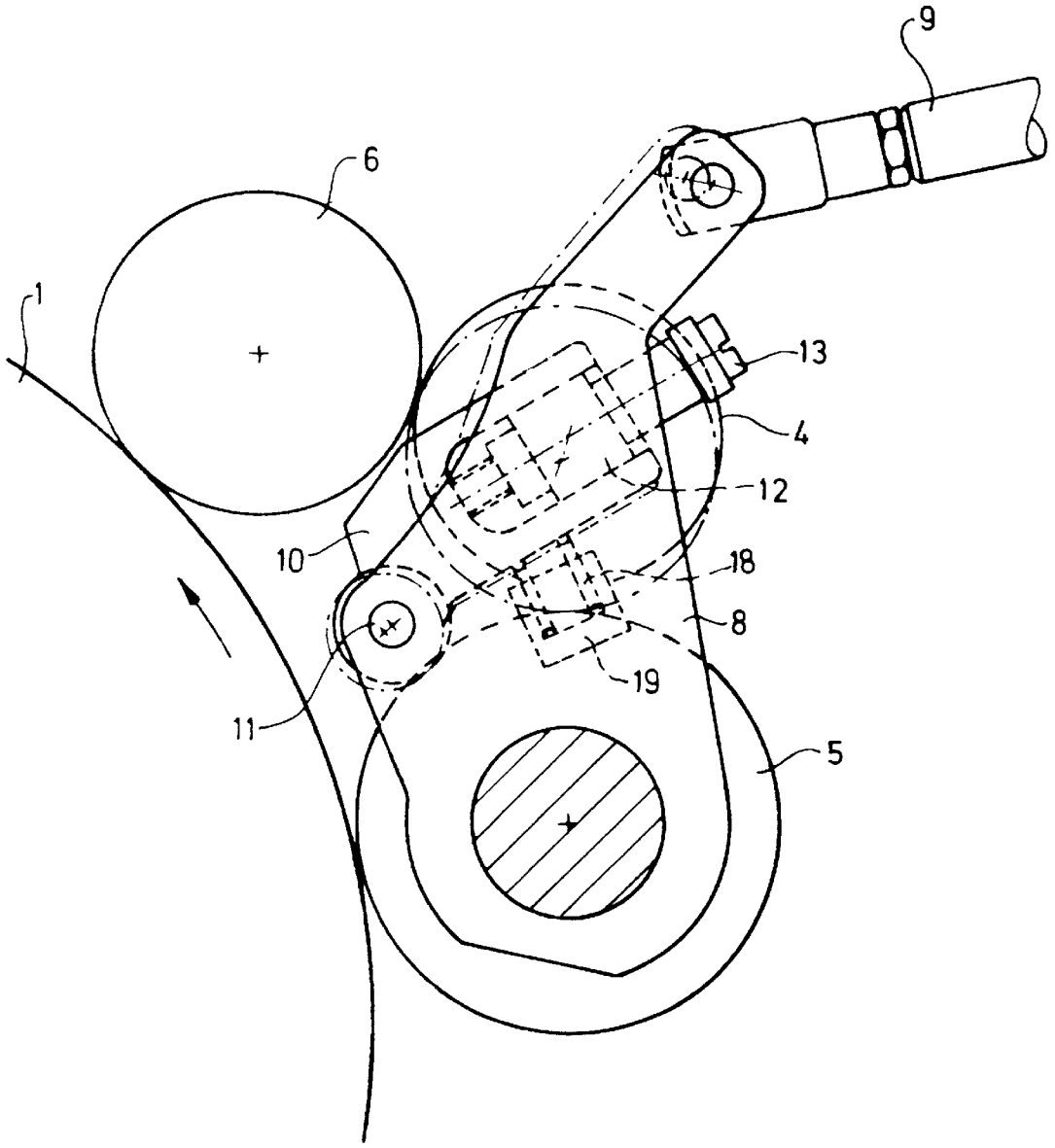
FIG. 4 shows a variant system of bearings of the intermediate roller.

The variant embodiment illustrated in FIG. 4 differs from the embodiment illustrated in FIG. 2 in that the connecting rod 14 is omitted, and in its place there can be one or more compression springs 18 which apply the bearing lever 10 and thus the intermediate roller 4 against the first inking roller 6. The compression springs 18 can be supported on support bodies 19 which can be fastened to the pivoted levers 8. In FIG. 4, the broken line indicates the position of the intermediate roller 4 in an applied position, in which the intermediate roller 4 can be in contact both with the first inking roller 6 and with the wetting roller 5. The extracted, or unapplied, position of the intermediate roller 4 is at a distance from the wetting roller 5, whereby the compression spring 18 can ensure an essentially constant contact with the cylindrical surface of the first inking roller 6.

Figure 5:
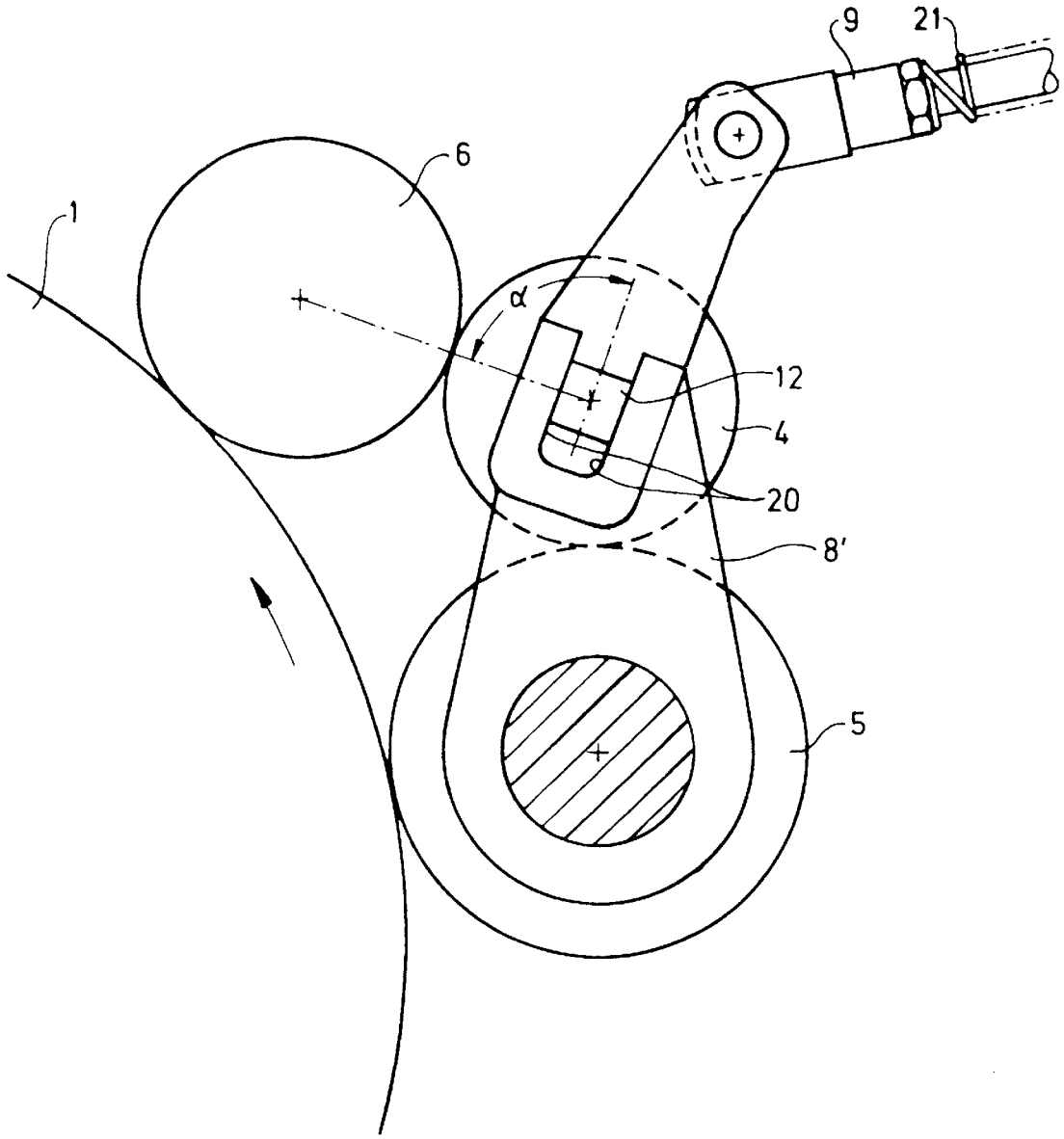
FIG. 5 shows a variant system of bearings of the intermediate roller.

FIG. 5 shows a variant embodiment in which, in the pivoted lever 8', there are guides 20. In the guides 20 the bearings 12 of the intermediate roller 4 can be frictionally guided. The guides 20 are preferably at an angle alpha with respect to the first inking roller 6, so that the application pressure of the intermediate roller 4 on the first inking roller 6 can preferably be greater than the application pressure of the intermediate roller 4 on the wetting roller 5. If the angle alpha is approximately 90 degrees, for example, compression springs 21, which compression springs 21 correspond to the actuator means 9, can push the intermediate roller 4 with substantially full force against the first inking roller 6. Only the dead weight of the intermediate roller 4 preferably represents a lower application force on the wetting roller 5. In this embodiment, the intermediate roller 4 can be driven by the first inking roller 6, aid the speed differential, if any, with respect to the wetting roller 5 can essentially have no effect on the intermediate roller 4, but results in a slip between the two rollers, the intermediate roller 4 and the wetting roller 5. In this embodiment, too, the intermediate roller 4 can essentially completely prevent a stenciling of the first inking roller 6.

One feature of the present invention resides broadly in the offset printing press with an inking and a wetting unit which correspond to a plate cylinder, with at least one intermediate roller which connects the friction-driven inking and wetting rollers, whereby the intermediate roller is bilaterally supported on bearings and can be adjusted by means of actuator means with respect to an inking and/or a wetting roller, characterized by the fact that the intermediate roller 4 is bilaterally mounted on pivoted levers 8, so that during adjustments it remains in rolling contact with the first inking roller 6, and when stopped, it is raised from the wetting roller 5.

Another feature of the invention resides broadly in the offset printing press characterized by the fact that connecting rods 14 are located bilaterally on the bearing systems 15 of the first inking roller 6, which connecting rods 14 are engaged in the bearings 12 of the intermediate roller 4, and there are actuator means 16 which correspond to the connecting rods 14.

Yet another feature of the present invention resides broadly in the offset printing press characterized by the fact that pivoted lever 8 are mounted bilaterally on the bearing systems 17 of the wetting roller 5, corresponding to which pivoted levers 8 there are actuator means 9, bearing levers 10 are pivotably fastened to the pivoted levers 8, and the intermediate roller 4 is mounted on the bearing levers 10, and engaged on the bearing levers 10 of the intermediate roller 4 are connecting rods 14 which are pivotably mounted bilaterally on the bearing systems 15 of the first inking roller 6.

Still another feature of the invention resides broadly in the offset printing press characterized by the fact that on the connecting rods 14 there are set screws 16 which are engaged on the bearing levers 10 of the intermediate roller 4, to adjust the distance between the intermediate roller 4 and the first inking roller 6.

A further feature of the invention resides broadly in the offset printing press characterized by the fact that pivoted levers 8 are mounted bilaterally on the bearing systems 17 of the wetting roller 5, with actuator means 9 corresponding to the pivoted levers 8, bearing levers 10 are pivotably fastened to the pivoted levers 9, on which bearing levers 10 the intermediate roller 4 is mounted, and corresponding to the bearing levers 8 are compression springs 18 which apply the intermediate roller 4 against the first inking roller 6, whereby the compression springs 18 are held by support bodies 19 which are fastened to the pivoted levers 8.

Another feature of the invention resides broadly in the offset printing press characterized by the fact that pivoted levers 8' are mounted bilaterally on the bearing systems 17 of the wetting roller 5, corresponding to which pivoted levers 8' there are actuator means 9, on the pivoted levers 8' there are guides 20 in which the bearings 12 of the intermediate roller 4 are frictionally guided, and the guides 20 are oriented at an angle alpha in relation to the first inking roller 6, so that the application pressure of the intermediate roller 4 against the first inking roller 6 is greater than the application pressure of the intermediate roller 4 against the wetting roller 5.

Some examples of printing press arrangements or apparatus which could possibly be used or which could possibly be adapted for use in the context of the present invention might be disclosed by the following U.S. Patents, all of which have been assigned to the assignee of the present invention: U.S. Pat. No. 5,408,928, U.S. Pat. No. 5,086,696, U.S. Pat. No. 4,922,818, U.S. Pat. No. 4,440,081 and U.S. Pat. No. 4,351,236.

Other examples of printing press arrangements or apparatus which could possibly be used or which could possibly be adapted for use in the context of the present invention might be disclosed by the following Federal Republic of Germany Patents, all of which have been assigned to the assignee of the present invention: DE 28 45 392 A1, DE 31 46 223 A1 and DE 40 13 741 A1.

Additional examples of printing press arrangements or apparatus which could possibly be used or which could possibly be adapted for use in the context of the present invention might be disclosed by the following U.S. Patents: U.S. Pat. No. 5,090,314, U.S. Pat. No. 5,025,724, U.S. Pat. No. 5,005,474 and U.S. Pat. No. 4,899,653.

Yet other examples of printing press arrangements or apparatus which could possibly be used or which could possibly be adapted for use in the context of the present invention might be disclosed by the following Federal Republic of Germany or European Patents: DE 44 19 850 A1 , DE 39 08 043 C1, DE 38 25 517 C2, DE 36 41 013 A1, G 93 16 916.7, EP 0 353 194 B1 and EP 0 478 493 A1.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 41 418.7, filed on Nov. 7, 1995, having inventors Hermann Beisel and Rudi Junghans, and DE-OS 195 41 418.7 and DE-PS 195 41 418.7, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A device for selectively engaging a wetting unit with an inking unit of a plate cylinder in an offset printing press, said device comprising:

a wetting unit;

said wetting unit comprising a wetting roller;

an inking unit;

said inking unit comprising an inking roller;

an intermediate roller;

said intermediate roller comprising a first end and a second end;

said intermediate roller being disposed to make direct contact with both said wetting roller and said inking roller;

said second end of said intermediate roller being axially opposite said first end of said intermediate roller;

a pivoting arrangement for pivoting said intermediate roller about said inking roller and maintaining said intermediate roller in contact with said inking roller;

said pivoting arrangement comprising:

a first lever;

said first end of said intermediate roller being rotationally mounted on said first lever;

a second lever;

said second end of said intermediate roller being rotationally mounted on said second lever; and each of said first lever and said second lever being disposed to pivot about its corresponding pivot point; and actuation apparatus for pivoting each of said first lever and said second lever about its corresponding pivot point to engage and disengage said intermediate roller with said wetting roller.

2. The device according to claim 1, wherein:

said inking roller has an axis of rotation;

said wetting roller has an axis of rotation;

both of said first lever and said second lever are disposed to pivot about the axis of rotation of one of: said inking roller and said wetting roller.

3. The device according to claim 2, wherein said both of said first lever and said second lever are disposed to pivot about the axis of rotation of said wetting roller.

4. The device according to claim 3, wherein:

said pivoting arrangement further comprises a second pivoting arrangement for rotatingly mounting said first end and said second end of said intermediate roller on said corresponding first and second levers;

said second pivoting arrangement comprises:

a third lever;

said third lever is pivotally mounted on said first lever;

said first end of said intermediate roller is rotationally mounted on said third lever;

a fourth lever;

said fourth lever is pivotally mounted on said second lever; and said second end of said intermediate roller is rotationally mounted on said fourth lever.

5. The device according to claim 4, wherein:

said inking roller comprises a first end and a second end;

said first end of said inking roller is axially opposite said second end of said inking roller; and said second pivoting arrangement comprises:

a fifth lever;

said fifth lever comprises a first end and a second end;

said second end of said fifth lever is disposed a substantial distance from said first end of said fifth lever;

said first end of said fifth lever is pivotally mounted on said first end of said inking roller to pivot about the axis of rotation of said inking roller;

said second end of said fifth lever is pivotally mounted on said third lever to pivot about the axis of rotation of said intermediate roller;

a sixth lever;

said sixth lever comprises a first end and a second end;

said second end of said sixth lever is disposed a substantial distance from said first end of said sixth lever;

said first end of said sixth lever is pivotally mounted on said second end of said inking roller to pivot about the axis of rotation of said inking roller; and said second end of said sixth lever is pivotally mounted on said fourth lever to pivot about the axis of rotation of said intermediate roller.

6. The device according to claim 5, wherein:

said second pivoting arrangement comprises an adjusting arrangement for adjusting a distance between said intermediate roller and said inking roller; and said adjusting arrangement comprises:

a first stop portion;

one of said third lever and said fourth lever comprises said first stop portion;

a second stop portion;

a corresponding one of said fifth lever and said sixth lever pivotally mounted on said at least one of said third lever and said fourth lever comprises said second stop portion;

said first stop portion is disposed to contact said second stop portion to limit pivotal displacement of said third and fourth levers towards said wetting roller;

at least one screw;

said at least one screw is threadingly disposed within said corresponding one of said fifth lever and said sixth lever;

said at least one screw comprises a first end and an opposite second end; and said first end of said at least one screw comprises said second stop portion.

7. The device according to claim 5, wherein said second pivoting arrangement comprises:

a first support body;

said first support body is fastened on said first lever;

a second support body;

said second support body is fastened on said second lever;

a first spring;

a second spring;

said first spring is disposed between said first support body and said third lever to urge said third lever to pivot towards said inking roller; and said second spring is disposed between said second support body and said fourth lever to urge said fourth lever to pivot towards said inking roller.

8. The device according to claim 3, wherein:

said first lever comprises a first guide portion;

said second lever comprises a second guide portion;

said first guide portion comprises a slot;

said second guide portion comprises a slot;

said first end of said intermediate roller is rotationally and slidingly disposed in said slot of said first guide portion; and said second end of said intermediate roller is rotationally and slidingly disposed in said slot of said second guide portion.

9. The device according to claim 8, wherein:

each of said slots of said first and second guide portions comprises a longitudinal axis substantially perpendicular to the axis of rotation of said intermediate roller;

the axis of rotation of said inking roller and the axis of rotation of said intermediate roller engaged with said wetting roller defines a plane; and each longitudinal axis of said slots of said first and second guide portions is disposed at an angle with respect to the plane whereby, with said intermediate roller engaged with said wetting roller, the pressure applied by the weight of said intermediate roller against said inking roller is greater than the pressure applied by the weight of said intermediate roller against said wetting roller.

10. The device according to claim 2, wherein both of said first lever and said second lever are disposed to pivot about the axis of rotation of said wetting roller.

11. The device according to claim 10, wherein said actuation apparatus comprises:

at least one screw;

said at least one screw comprises a first end and an opposite second end;

said at least one screw is threadingly disposed in one of said first lever and said second lever;

a second pivoting arrangement; and an end of said at least one screw is disposed to engage said second pivoting arrangement.

12. The device according to claim 11, wherein said second pivoting arrangement comprises:

a third lever;

said third lever comprises a first end and a second end;

said first end of said third lever is pivotally mounted on said first lever;

said second end of said third lever is disposed a substantial distance from said first end of said third lever;

said first end of said intermediate roller is rotationally mounted on said first end of said third lever;

a fourth lever;

said fourth lever comprises a first end and a second end;

said first end of said fourth lever is pivotally mounted on said second lever;

said second end of said fourth lever is disposed a substantial distance from said first end of said fourth lever;

said second end of said intermediate roller is rotationally mounted on said first end of said fourth lever;

a fifth lever;

said fifth lever is pivotally mounted on said first end of said wetting roller to pivot about the axis of rotation of said wetting roller;

said second end of said third lever is pivotally mounted on said fifth lever;

a sixth lever;

said sixth lever is pivotally mounted on said second end of said wetting roller to pivot about the axis of rotation of said wetting roller;

said second end of said fourth lever is pivotally mounted on said sixth lever; and said end of said at least one screw is disposed to engage a corresponding one of said third lever and said fourth lever pivotally mounted on said one of said first lever and said second lever.

13. An offset printing press, said offset printing press comprising:

a plate cylinder;

an inking unit for said plate cylinder;

said inking unit comprising an inking roller;

a wetting unit for said plate cylinder;

said wetting unit comprising a wetting roller;

an intermediate roller for connecting said inking roller and said wetting roller;

said intermediate roller being disposed to make direct contact with both said inking roller and said wetting roller;

said intermediate roller comprising a first end and a second end;

said first end of said intermediate roller being opposite said second end of said intermediate roller;

apparatus for selectively connecting said inking roller and said wetting roller with said intermediate roller and for keeping said intermediate roller in contact with said inking roller;

said apparatus for selectively connecting said inking roller and said wetting roller with said intermediate roller and for keeping said intermediate roller in contact with said inking roller comprising:

a first lever;

said first end of said intermediate roller being rotationally mounted on said first lever;

a second lever; and said second end of said intermediate roller being rotationally mounted on said second lever; and apparatus for actuating said apparatus for selectively connecting said inking roller and said wetting roller with said intermediate roller and for keeping said intermediate roller in contact with said inking roller.

14. The offset printing press according to claim 13, wherein:

said inking roller comprises an axis of rotation;

said wetting roller comprises an axis of rotation; and said first lever and said second lever are disposed to pivot about the axis of rotation of one of: said inking roller and said wetting roller.

15. The offset printing press according to claim 14, wherein:

said wetting roller comprises a first end and a second end;

said first end of said wetting roller is axially opposite said second end of said wetting roller;

said first lever and said second lever are disposed to pivot about the axis of rotation of said inking roller;

each of said first and second ends of said intermediate roller comprises a plurality of bearings for rotationally mounting said intermediate roller;

each of said first lever and said second lever engages said plurality of bearings corresponding to said first end and said second end of said intermediate roller mounted to said first lever and said second lever; and said apparatus for actuating comprises:

at least one screw;

said at least one screw is threadingly disposed in one of said first lever and said second lever;

a third lever;

said third lever comprises a first end and a second end;

said first end of said third lever is pivotally mounted on said first lever;

said second end of said third lever is disposed a substantial distance from said first end of said third lever;

said first end of said intermediate roller is rotationally mounted on said second end of said third lever;

a fourth lever;

said fourth lever comprises a first end and a second end;

said first end of said fourth lever is pivotally mounted on said second lever;

said second end of said fourth lever is disposed a substantial distance from said first end of said fourth lever;

said second end of said intermediate roller is rotationally mounted on said second end of said fourth lever;

a fifth lever;

said fifth lever is pivotally mounted on said first end of said wetting roller to pivot about the axis of rotation of said wetting roller;

said second end of said third lever is pivotally mounted on said fifth lever;

a sixth lever;

said sixth lever is pivotally mounted on said second end of said wetting roller to pivot about the axis of rotation of said wetting roller;

said second end of said fourth lever is pivotally mounted on said sixth lever; and said at least one screw is disposed to engage said corresponding one of said third lever and said fourth lever pivotally mounted on said one of said first lever and said second lever.

16. The offset printing press according to claim 14, wherein said first lever and said second lever are disposed to pivot about an axis of rotation of said wetting roller.

17. The offset printing press according to claim 16, wherein said apparatus for selectively connecting said inking roller and said wetting roller with said intermediate roller and for keeping said intermediate roller in contact with said inking roller comprises:

a third lever;

said third lever is pivotally mounted on said first lever;

said first end of said intermediate roller is rotationally mounted on said third lever;

a fourth lever;

said fourth lever is pivotally mounted on said second lever;

said second end of said intermediate roller is rotationally mounted on said fourth lever;

a fifth lever;

said fifth lever comprises a first end and a second end;

said second end of said fifth lever is disposed a substantial distance from said first end of said fifth lever;

said first end of said fifth lever is pivotally mounted on said first end of said inking roller to pivot about the axis of rotation of said inking roller;

said second end of said fifth lever is pivotally mounted on said third lever to pivot about the axis of rotation of said intermediate roller;

a sixth lever;

said sixth lever comprises a first end and a second end;

said second end of said sixth lever is disposed a substantial distance from said first end of said sixth lever;

said first end of said sixth lever is pivotally mounted on said second end of said inking roller to pivot about the axis of rotation of said inking roller; and said second end of said sixth lever is pivotally mounted on said fourth lever to pivot about the axis of rotation of said intermediate roller.

18. The offset printing press according to claim 17, wherein:

said apparatus for selectively connecting said inking roller and said wetting roller with said intermediate roller and for keeping said intermediate roller in contact with said inking roller comprises an adjusting arrangement for varying a distance between said intermediate roller and said inking roller; and said adjusting arrangement comprises:

a first stop portion;

one of said third lever and said fourth lever comprises said first stop portion;

a second stop portion;

a corresponding one of said fifth lever and said sixth lever pivotally mounted on said one of said third lever and said fourth lever comprises said second stop portion;

said first stop portion is disposed to contact said second stop portion to limit pivotal displacement of said third and fourth levers towards said wetting roller;

at least one screw;

said at least one screw is threadingly disposed within said corresponding one of said fifth lever and said sixth lever;

said at least one screw comprises a first end and an opposite second end; and said first end of said at least one screw comprises said second stop portion.

19. The offset printing press according to claim 16, wherein said apparatus for selectively connecting said inking roller and said wetting roller with said intermediate roller and for keeping said intermediate roller in contact with said inking roller comprises:

a third lever;

said third lever is pivotally mounted on said first lever;

said first end of said intermediate roller is rotationally mounted on said third lever;

a fourth lever;

said fourth lever is pivotally mounted on said second lever;

said second end of said intermediate roller is rotationally mounted on said fourth lever;

a first support body;

said first support body is fastened on said first lever;

a second support body;

said second support body is fastened on said second lever;

a first spring;

a second spring;

said first spring is disposed between said first support body and said third lever to urge said third lever to pivot towards said inking roller; and said second spring is disposed between said second support body and said fourth lever to urge said fourth lever to pivot towards said inking roller.

20. The offset printing press according to claim 16, wherein:

said first lever comprises a first guide portion;

said second lever comprises a second guide portion;

said first guide portion comprises a slot;

said second guide portion comprises a slot;

said first end of said intermediate roller is rotationally and slidingly disposed in said slot of said first guide portion;

said second end of said intermediate roller is rotationally and slidingly disposed in said slot of said second guide portion;

each of said slots of said first and second guide portions comprise a longitudinal axis substantially perpendicular to the axis of rotation of said intermediate roller;

the axis of rotation of said inking roller and the axis of rotation of said intermediate roller engaged with said wetting roller defines a plane; and each longitudinal axis of said slots of said first and second guide portions are disposed at an angle with respect to the plane whereby with said intermediate roller engaged with said wetting roller, the pressure applied by the weight of said intermediate roller against said inking roller is greater than the pressure applied by the weight of said intermediate roller against said wetting roller.

* * * * *

UNITED STATES PATENT AND TRADEMARK OFFICE

CERTIFICATE OF CORRECTION

PATENT NO. : 5,823,107

DATED : October 20, 1998

INVENTOR(S) : HermannBEISEL and Rudi JUNGHANS

It is certified that error appears in the above-identified patent and that said Letters Patent is hereby corrected as shown below:

In column 8, between lines 19 and 20, Claim 1, indert the following new paragraph:

--said wetting unit being configured to apply wetting agent to the plate cylinder;--.

In column 8, between lines 21 and 22, Claim 1, insert the following new paragraph:

--said wetting roller being disposed in direct contact with the plate cylinder to apply wetting fluid from a wetting fluid supply directly to the plate cylinder;--.

UNITED STATES PATENT AND TRADEMARK OFFICE

CERTIFICATE OF CORRECTION

PATENT NO. : 5,823,107

DATED : October 20, 1998

INVENTOR(S) : Hermann BEISEL and Rudi JUNGHANS

It is certified that error appears in the above-identified patent and that said Letters Patent is hereby corrected as shown below:

In column 8, between lines 24 and 25, Claim 1, insert the following new paragraph:

--said inking roller being disposed in continuous direct contact with the plate cylinder to apply ink directly to the plate cylinder;--.

In column 11, between lines 22 and 23, Claim 13, insert the following paragraph:

--said inking roller being disposed in continuous direct contact with the plate cylinder to apply ink directly to the plate cylinder;--.

UNITED STATES PATENT AND TRADEMARK OFFICE

CERTIFICATE OF CORRECTION

PATENT NO. : 5,823,107

DATED : October 20, 1998

INVENTOR(S) : Hermann BEISEL and Rudi JUNGHANS

It is certified that error appears in the above-identified patent and that said Letters Patent is hereby corrected as shown below:

In column 11, between lines 23 and 24, Claim 13, insert the following paragraph:

--said wetting unit being configured to apply wetting agent to the plate cylinder;--.

In column 11, between lines 24 and 25, Claim 13, insert the following paragraph:

--said wetting roller being disposed in direct contact with the plate cylinder to apply wetting fluid from a wetting fluid supply directly to the plate cylinder;--.

Signed and Sealed this

Thirty-first Day of August, 1999

*Attest:*

Q. TODD DICKINSON

*Attesting Officer*

*Acting Commissioner of Patents and Trademarks*